US010062364B1

(12) United States Patent
Amaral

(10) Patent No.: US 10,062,364 B1
(45) Date of Patent: Aug. 28, 2018

(54) DRUMSTICK SLEEVE

(71) Applicant: Justin M. Amaral, Madison, TN (US)

(72) Inventor: Justin M. Amaral, Madison, TN (US)

( * ) Notice: Subject to any disclaimer, the term of this patent is extended or adjusted under 35 U.S.C. 154(b) by 0 days.

(21) Appl. No.: 15/807,044

(22) Filed: Nov. 8, 2017

Related U.S. Application Data

(60) Provisional application No. 62/470,442, filed on Mar. 13, 2017, provisional application No. 62/420,453, filed on Nov. 10, 2016.

(51) Int. Cl.
*G10D 13/00* (2006.01)
*A45F 5/00* (2006.01)

(52) U.S. Cl.
CPC ..... *G10D 13/003* (2013.01); *A45F 5/00* (2013.01); *A45F 2005/008* (2013.01)

(58) Field of Classification Search
CPC .... G10D 13/003; A45F 5/00; A45F 2005/008
USPC ..... 84/422.4
See application file for complete search history.

(56) References Cited

U.S. PATENT DOCUMENTS 2,575,126 A * 11/1951 Ramsey ..... F41B 5/066 124/23.1
2,715,990 A * 8/1955 Austin ..... F41B 5/063 124/25.7
3,365,108 A * 1/1968 Giba ..... G10D 13/003 224/217
3,859,887 A * 1/1975 Buchanan ..... G10D 13/003 84/422.4
4,326,706 A * 4/1982 Guthrie ..... A63B 21/065 2/160
4,523,702 A * 6/1985 Viio ..... A45F 5/00 206/479
D297,546 S * 9/1988 Seals ..... D17/22
4,793,005 A * 12/1988 Hetzel, Jr. ..... A41D 19/01547 2/161.1
5,018,221 A * 5/1991 Romandetto .... A41D 19/01588 128/878
5,088,121 A * 2/1992 Wallace ..... B65D 83/384 2/158
5,117,724 A * 6/1992 Gardner ..... G10D 13/003 206/314
5,199,621 A * 4/1993 McLennan ..... A45F 5/00 224/223
5,276,922 A * 1/1994 Floyd, Jr. ..... A41D 19/01594 2/160
5,370,288 A * 12/1994 Field ..... A45C 13/02 211/60.1
5,435,220 A * 7/1995 Pultz ..... G10D 13/003 206/314

(Continued)

*Primary Examiner* — David Warren
*Assistant Examiner* — Christina Schreiber
(74) *Attorney, Agent, or Firm* — Shane V. Cortesi

(57) ABSTRACT

The present invention relates to a drumstick sleeve system. The system may include an elastic sleeve configured to be worn around a user's arm and comprising a sleeve front end, a sleeve rear end, a sleeve length extending from the sleeve front end to the sleeve rear end, a sleeve width generally perpendicular to the sleeve length, a sleeve interior configured to receive the user's arm, a sleeve exterior, a pocket comprising a pocket front entry portal, a pocket rear exit portal, and a pocket length extending from the pocket front entry portal to the pocket rear exit portal, the pocket length generally parallel to the sleeve length. The pocket is configured to receive a drumstick and the drumstick may be removably secured to the sleeve exterior with the at least one strap.

12 Claims, 7 Drawing Sheets

(56) References Cited

U.S. PATENT DOCUMENTS 5,522,300 A * 6/1996 Cheatwood ..... G10D 13/003 206/314
5,722,575 A 3/1998 Smith
5,890,228 A * 4/1999 Wagner ..... A63B 69/3608 2/160
5,967,391 A * 10/1999 Hunt ..... A01M 31/004 224/222
6,365,813 B1 * 4/2002 Gress ..... G10D 13/003 84/422.4
6,443,341 B1 * 9/2002 Rittmann ..... A45C 1/04 150/149
6,553,574 B1 * 4/2003 Hall, Jr. ..... A63B 21/065 2/160
6,810,531 B1 * 11/2004 Lento ..... G10D 13/003 2/159
7,048,162 B2 * 5/2006 Frye ..... A45D 29/20 206/373
7,435,889 B1 * 10/2008 Heidt ..... G10D 13/003 84/320
7,687,699 B2 * 3/2010 Briggs ..... G10D 13/003 84/329
8,410,345 B2 * 4/2013 Patrick ..... G10D 13/022 84/411 M
9,155,951 B2 * 10/2015 Ahern ..... A63B 69/0059
2006/0011679 A1 * 1/2006 Santiago ..... B25H 3/00 224/222
2007/0245880 A1 * 10/2007 Perkins ..... G10D 13/003 84/422.4
2009/0308227 A1 * 12/2009 Mackie ..... G10D 13/003 84/422.4
2012/0279379 A1 * 11/2012 Kairis ..... G10D 13/003 84/422.4
2014/0060285 A1 * 3/2014 Bradfield ..... G10D 13/003 84/411 R
2015/0302837 A1 * 10/2015 Massimo ..... G10D 13/003 206/314

* cited by examiner

DRUMSTICK SLEEVE

RELATED APPLICATIONS

This application claims priority under 35 USC 119 to US Provisional Application Nos. 62/470,442, filed Mar. 13, 2017, and 62/420,453, filed Nov. 10, 2016, the entire contents of both of which are incorporated by reference in their entirety.

BACKGROUND

Technical Field

The present invention relates to music instrument accessories, more particularly drumstick accessories.

Background of the Invention

Traditionally, drumsticks are held in a user's hands and the user taps the drumsticks against the drum.

Various devices have been described for holding a drumstick. For example, U.S. Pat. No. 3,365,108 describes a retaining device for a drumstick in the form of a ring worn around a user's finger.

U.S. Pat. No. 5,199,621 describes a drumstick holster. The holster includes straps that can be used to secure the holster to the user's arms or legs. The holster is configured to store the drumstick.

There aforementioned devices are designed to hold drumsticks. There remains a need for drumstick accessories that are designed to allow the user to create a unique sound.

BRIEF SUMMARY

The present disclosure provides a drumstick sleeve as described herein.

In some embodiments, the present disclosure provides a drumstick sleeve system comprising: an elastic sleeve configured to be worn around a user's arm and comprising a sleeve front end, a sleeve rear end, a sleeve length extending from the sleeve front end to the sleeve rear end, a sleeve width generally perpendicular to the sleeve length, a sleeve interior configured to receive the user's arm, a sleeve exterior comprising a pocket comprising a pocket front entry portal, a pocket rear exit portal, a pocket length extending from the pocket front entry portal to the pocket rear exit portal, the pocket length generally parallel to the sleeve length, and at least one strap located on the sleeve exterior to the rear of the pocket rear exit portal; a drumstick comprising a front end, a rear end, a drumstick length extending from the drumstick front end to the drumstick rear end and generally parallel to the sleeve length, the drumstick removably positioned in the pocket.

Optionally, the at least one strap extends over the drumstick adjacent to the drumstick rear end and secures the drumstick to the sleeve. Optionally, the at least one strap comprises a strap first end fixed to the sleeve exterior, a strap second end, and a fastener configured to removably attach the strap second end to the sleeve exterior. Optionally, the fastener comprises a hook and loop fastener.

The present disclosure also provides a method of wearing a drumstick sleeve system comprising the steps of: a) providing an elastic sleeve configured to be worn around a user's arm and comprising a front end, a rear end, a sleeve length extending from the front end to the rear end, a sleeve width generally perpendicular to the sleeve length, a sleeve interior configured to receive the user's arm, a sleeve exterior comprising a pocket comprising a pocket front entry portal, a pocket rear exit portal, a pocket length extending from the pocket front entry portal to the pocket rear exit portal, the pocket length generally parallel to the sleeve length, and at least one strap located on the sleeve exterior to the rear of the pocket rear exit portal; b) providing a drumstick comprising a front end, a rear end, a drumstick length extending from the drumstick front end to the drumstick rear end; c) placing the elastic sleeve on an arm of a human user so that the drumstick extends below a palm of the human user's hand; and d) removably positioning the drumstick in the pocket.

Optionally, the method further comprises the step of tapping the drumstick against a drum after step d). Optionally, the method further comprises: e) extending the at least one strap over the drumstick adjacent to the drumstick rear end to secure the drumstick to the sleeve exterior.

In still further embodiments, the present disclosure provides a drumstick sleeve system comprising: an elastic sleeve configured to be worn around a user's arm and comprising a sleeve front end, a sleeve rear end, a sleeve length extending from the sleeve front end to the sleeve rear end, a sleeve width generally perpendicular to the sleeve length, a sleeve interior configured to receive the user's arm, a sleeve exterior, a first pocket comprising a first pocket front entry portal, a first pocket rear exit portal, a first pocket length extending from the first pocket front entry portal to the first pocket rear exit portal, the first pocket length generally parallel to the sleeve length; and a drumstick comprising a front end, a rear end, a drumstick length extending from the drumstick front end to the drumstick rear end and generally parallel to the sleeve length, the drumstick removably positioned in the first pocket (i.e., in the first pocket interior).

Optionally, the elastic sleeve further comprises a second pocket comprising a second pocket front entry portal, a second pocket rear end, a second pocket length extending from the second pocket front entry portal to the second pocket rear end, the second pocket length generally parallel to the sleeve length and the first pocket length. Optionally, the second pocket rear end is closed. Optionally, the first pocket and the second pocket comprise an interior configured to receive the drumstick and wherein at least a portion of the second pocket interior is lined with a non-slip surface, and further wherein the first pocket interior adjacent to the first pocket entry does not comprise a non-slip surface. Optionally, the non-slip surface is comprised of a different material than the material forming the remainder of the elastic sleeve. Optionally, the elastic sleeve further comprises a third pocket comprising a third pocket front entry portal, a third pocket closed (e.g., sewn) rear end, a third pocket length extending from the thick pocket front entry portal to the third pocket closed rear end, the third pocket length generally parallel to the sleeve length, the first pocket length and the second pocket length. Optionally, the first pocket front entry portal is adjacent to the sleeve front end.

The present disclosure also provides a method of wearing a drumstick sleeve system comprising the steps of a) providing an elastic sleeve configured to be worn around a user's arm and comprising a sleeve front end, a sleeve rear end, a sleeve length extending from the sleeve front end to the sleeve rear end, a sleeve width generally perpendicular to the sleeve length, a sleeve interior configured to receive the user's arm, a sleeve exterior, a first pocket comprising a first pocket front entry portal, a first pocket rear exit portal, a first pocket length extending from the first pocket front entry portal to the first pocket rear exit portal, the first pocket length generally parallel to the sleeve length; b) providing a drumstick comprising a front end, a rear end, a drumstick length extending from the drumstick front end to the drumstick rear end; c) placing the elastic sleeve on an arm of a human user so that the drumstick extends below a palm of the human user's hand; and d) removably positioning the drumstick in the first pocket (i.e., in the first pocket interior).

Optionally, the method may include the step of tapping the drumstick against a drum after step d).

The method may also include placing the drumstick in either the second pocket interior or the third pocket interior.

DETAILED DESCRIPTION

Figure 1:
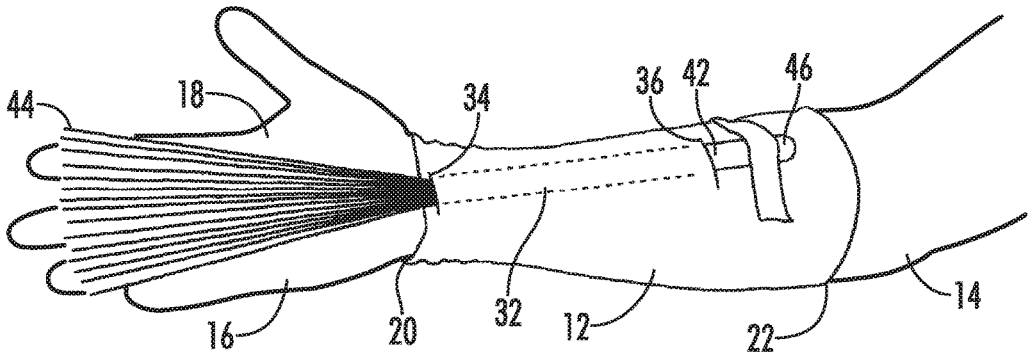
FIG. 1 illustrates a side perspective view of a drumstick sleeve of an embodiment of the present invention; the drumstick sleeve is holding a drumstick in the form of a drum brush and the drumstick sleeve is worn by the user.
Figure 2:
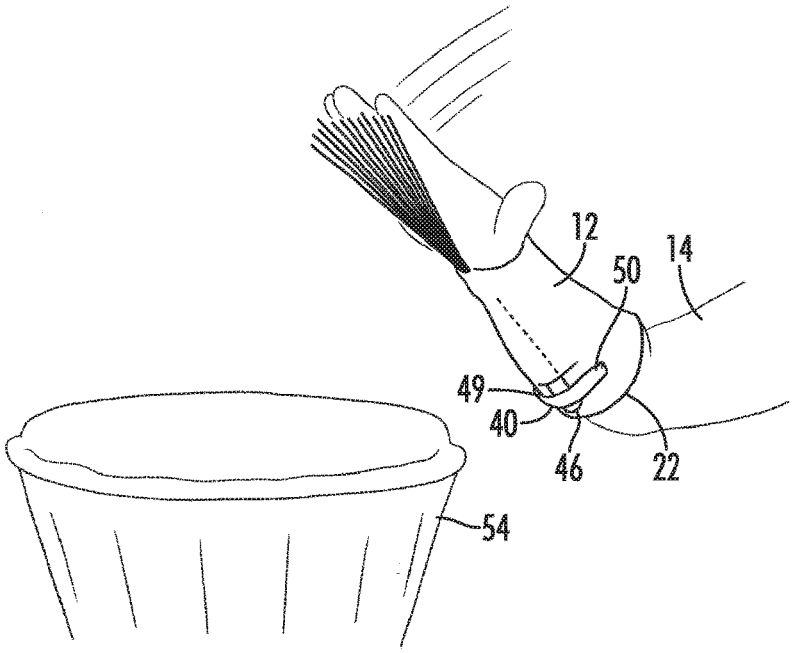
FIG. 2 illustrates a side perspective view of the drumstick sleeve of FIG. 1 being used by a user to tap a drum.
Figure 3:
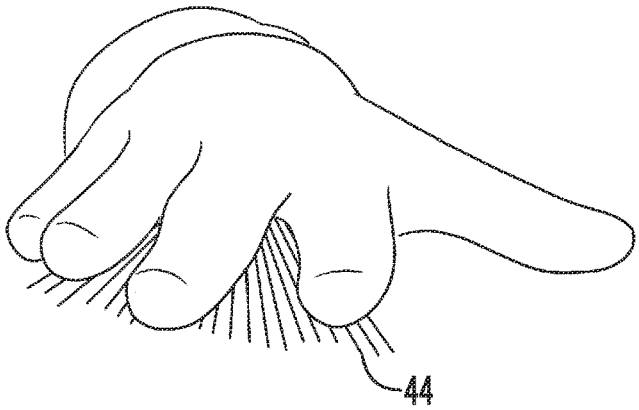
FIG. 3 illustrates a front perspective view of the drumstick sleeve and user's hand of FIG. 1.

With reference to FIGS. 1-8, the present invention provides a drumstick sleeve system 10. In the drawings, not all reference numbers are included in each drawing for the sake of clarity.

Referring further to FIGS. 1-8, the drumstick sleeve system 10 includes: an elastic sleeve 12 configured to be worn around a user's arm 14 and comprising a sleeve front end 20, a sleeve rear end 22, a sleeve length 24 extending from the sleeve front end 20 to the sleeve rear end 22, a sleeve width 26 generally perpendicular to the sleeve length 24, a sleeve interior 28 configured to receive the user's arm 14, a sleeve exterior 30, a pocket 32 comprising a pocket front entry portal 34, a pocket rear exit portal 36, a pocket length 38 extending from the pocket front entry portal 34 to the pocket rear exit portal 36, the pocket length 38 generally parallel to (and preferably at least 1 inch shorter than) the sleeve length 24, and at least one strap 40 located on the sleeve exterior 28 to the rear of the pocket rear exit portal 36. In some embodiments, the elastic sleeve 12 is comprised of spandex. In some embodiments, the pocket 32 is located on the sleeve exterior 30.

The system further 10 includes a drumstick 42 comprising a front end 44, a rear end 46, a drumstick length 48 extending from the drumstick front end 44 to the drumstick rear end 46. The drumstick length 48 may be generally parallel to the sleeve length 24 and is preferably at least 1 inch longer than the sleeve length 24 so that the drumstick front end 44 may be located beyond the front entry portal 34 and the drumstick rear end 46 may be located beyond the rear exit portal 36. The drumstick 42 is removably positioned in the pocket 32 and secured to the sleeve exterior 30 using the at least one strap 40. Optionally, the at least one strap 40 extends over the drumstick 42 adjacent to the drumstick rear end 46 and secures the drumstick 42 to the sleeve exterior 30. Optionally, the at least one strap 40 comprises a strap first end 49 fixed to the sleeve exterior 30, a strap second end 50, and a fastener 52 configured to removably attach the strap second end 50 to the sleeve exterior 30. Optionally, the fastener 52 comprises a hook and loop fastener, part of which is located on the strap second end 50 and the mating part of which is located on the sleeve exterior 30.

As used herein, the word "drumstick" refers to items that are used to strike a drum 54 and includes drum brushes as shown in FIGS. 1-5, as well as yarn/cotton mallets, stick shakers and the like.

Figure 4:
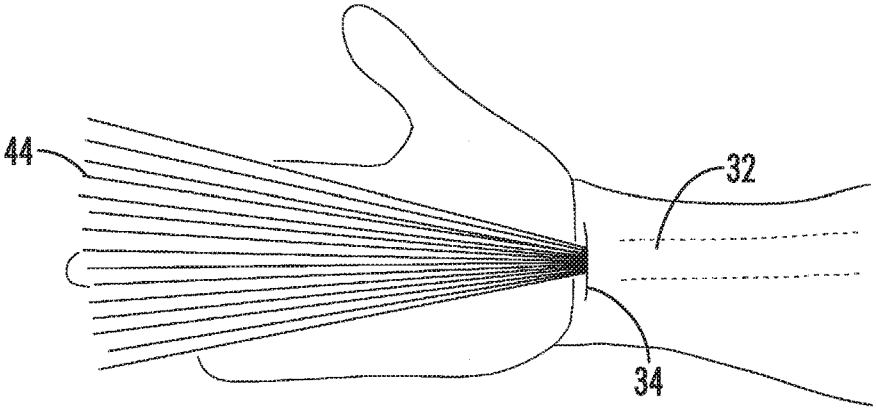
FIG. 4 illustrates a palm-side perspective view of the drumstick sleeve and user's palm of FIG. 1
Figure 5:
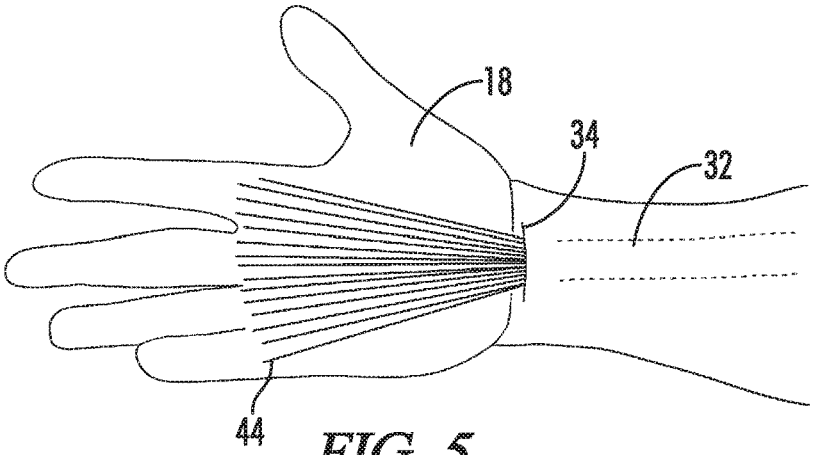
FIG. 5 illustrates another palm-side perspective view of the drumstick sleeve and user's palm of FIG. 1; as compared to FIG. 4, the drumstick has been moved rearwardly in FIG. 5.
Figure 6:
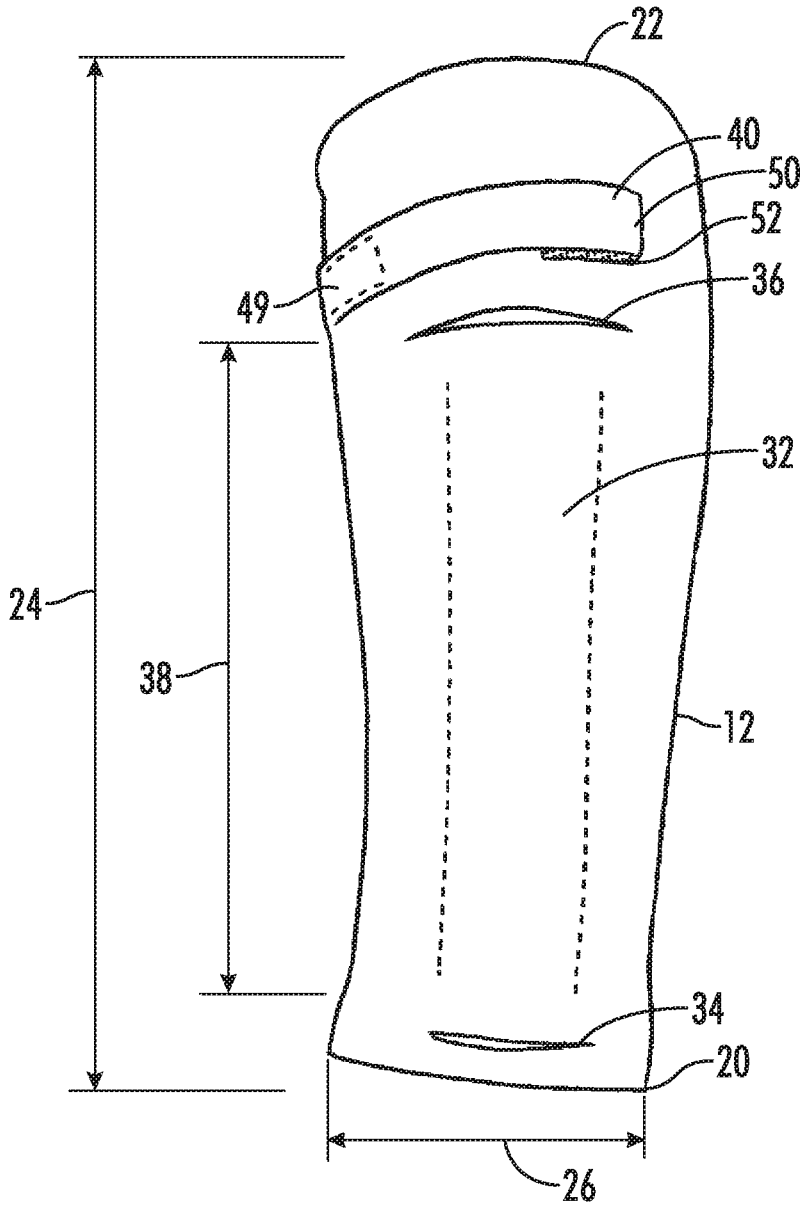
FIG. 6 illustrates a top, perspective view of the drumstick sleeve of FIG. 1.
Figure 7:
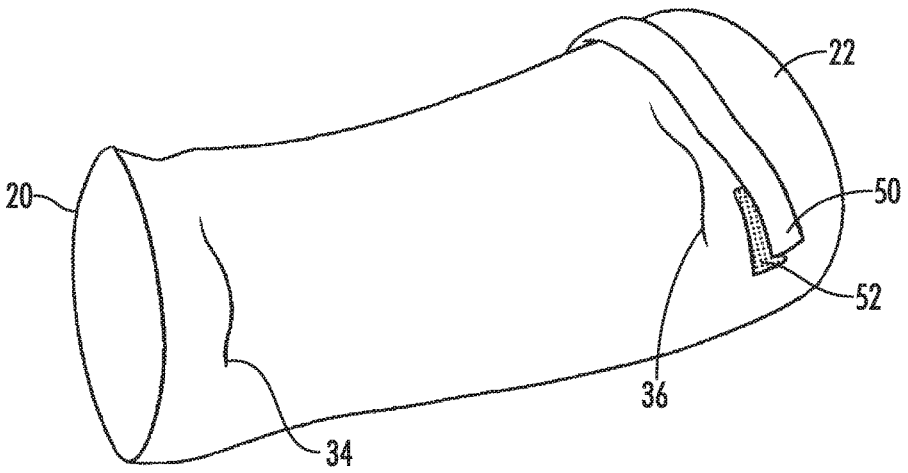
FIG. 7 illustrates a side perspective view of the drumstick sleeve of FIG. 1.
Figure 8:
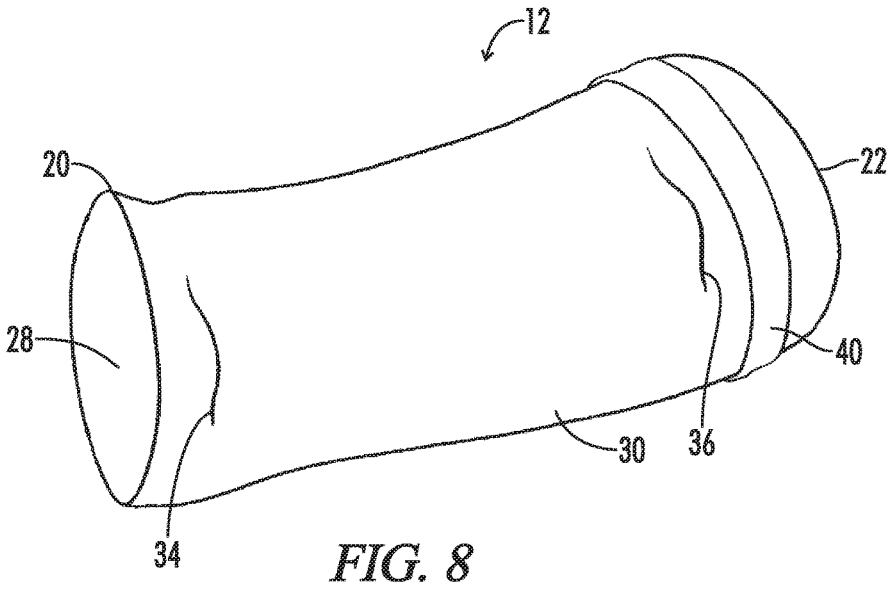
FIG. 8 illustrates a side perspective view of an alternate embodiment of a drumstick sleeve.
Figure 9:
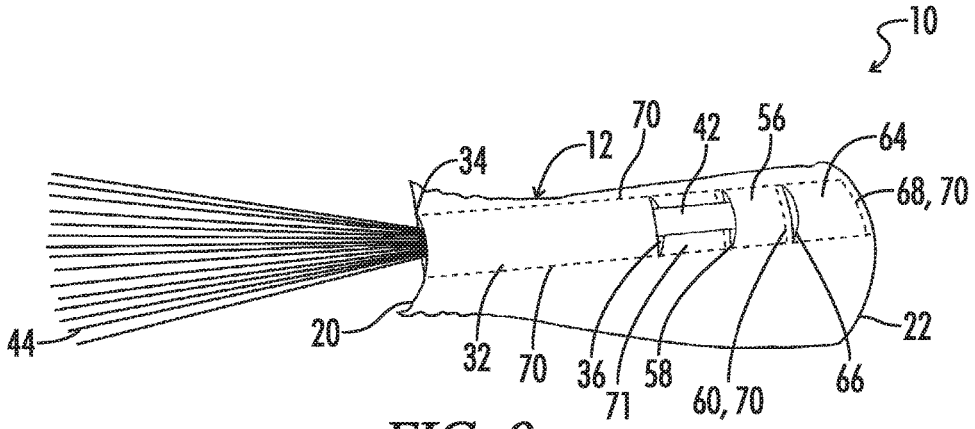
FIG. 9 illustrates a side perspective of a drumstick sleeve of an alternate embodiment of the present invention; the sleeve of FIG. 9 includes three pockets; the drumstick sleeve is holding a drumstick in the form of a drum brush and the drumstick sleeve is worn by the user.
Figure 10:
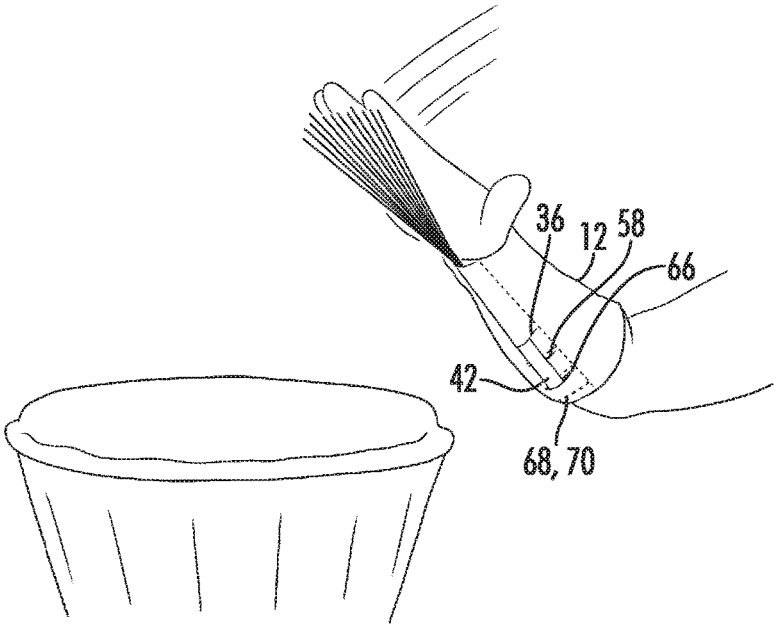
FIG. 10 illustrates a side perspective view of the drumstick sleeve of FIG. 9 being used to tap a drum.
Figure 11:
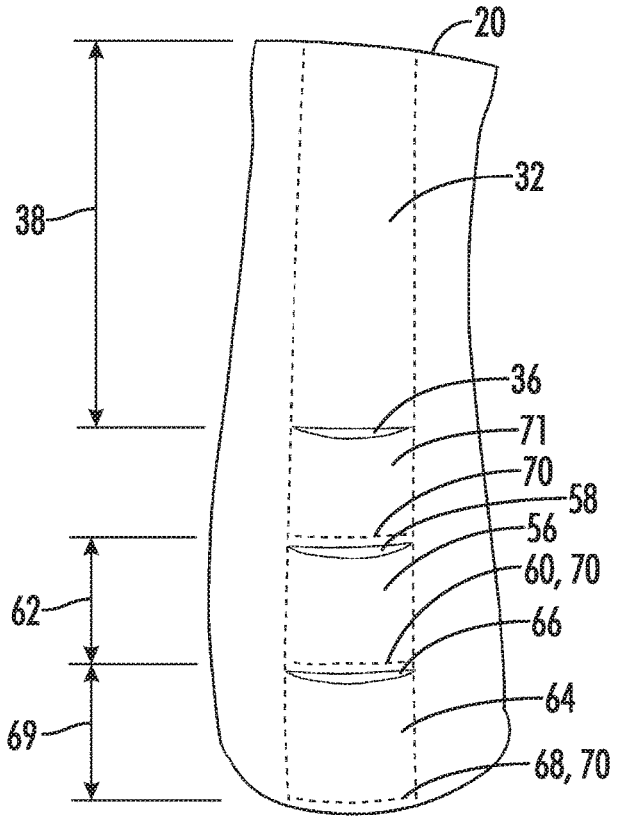
FIG. 11 illustrates a top, perspective view of the drumstick sleeve of FIG. 9.
Figure 12:
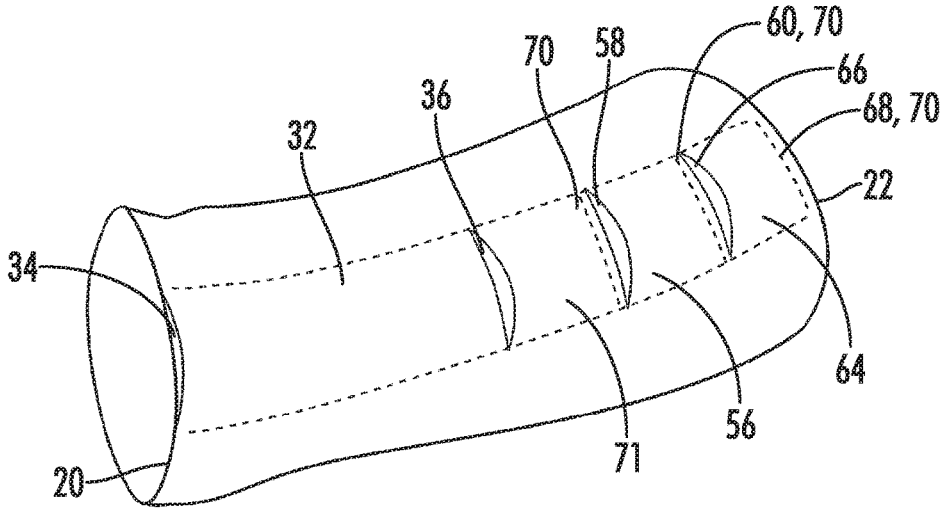
FIG. 12 illustrates a side perspective view of the drumstick sleeve of FIG. 9.

In use, the drumstick 42 extends forwardly beyond the sleeve front end 20 and under the palm 18 of the user's hand 16. The sleeve front end 20 may be adjacent to the user's wrist. The position of the drumstick 42 may be altered as shown in FIGS. 4-5.

The present disclosure also provides a method of wearing a drumstick sleeve system 10 comprising the steps of a) providing an elastic sleeve 12 configured to be worn around a user's arm 14 and comprising a front end 20, a rear end 22, a sleeve length 24 extending from the front end 20 to the rear end 22, a sleeve width 26 generally perpendicular to the sleeve length 24, a sleeve interior 28 configured to receive the user's arm 14, a sleeve exterior 30, a pocket 32 comprising a pocket front entry portal 34, a pocket rear exit portal 36, a pocket length 38 extending from the pocket front entry portal 34 to the pocket rear exit portal 36, the pocket length 38 generally parallel to the sleeve length 24, and at least one strap 40 located on the sleeve exterior 30 to the rear of the pocket rear exit portal 36;

b) providing a drumstick 42 comprising a front end 44, a rear end 46, a drumstick length 48 extending from the drumstick front end 44 to the drumstick rear end 46;

c) placing the elastic sleeve 12 on an arm 14 of a human user so that the drumstick 42 extends below a palm 18 of the human user's hand 16; and d) removably positioning the drumstick 42 in the pocket 32.

Optionally, the method further includes the step of tapping the drumstick 42 against a drum 54 after step d). Optionally, the method further comprises: e) extending the at least one strap 40 over the drumstick 42 adjacent to the drumstick rear end 46 to secure the drumstick 42 to the sleeve exterior 30.

The Embodiments of FIGS. 9-14

FIGS. 9-14 illustrate an alternate embodiment of the present invention. In particular, instead of a strap 40, the embodiments of FIGS. 9-14 include a second pocket 56 and a third pocket 64 aligned with the first pocket 32.

More particularly, in FIGS. 9-14, in addition to the first pocket 32, the elastic sleeve 12 further comprises a second pocket 56 comprising a second pocket front entry portal 58, a second pocket rear end 60, a second pocket length 62 extending from the second pocket front entry portal 58 to the second pocket rear end 60, the second pocket length 62 generally parallel to the sleeve length 24 and the first pocket length 38. Preferably, as shown in FIGS. 9-14, the second pocket rear end 60 does not have an exit portal and instead is sewn shut with stitching 70. A gap 71 may be present between the first pocket 32 and the second pocket 56, exposing the drumstick 42 as shown in FIGS. 9-14.

In FIGS. 9-14, the elastic sleeve 12 further comprises a third pocket 64 comprising a third pocket front entry portal 66, a third pocket rear end 68, a third pocket length 69 extending from the thick pocket front entry portal 66 to the third pocket rear end 68, the third pocket length 69 generally parallel to the sleeve length 24, the first pocket length 38 and the second pocket length 62. As shown in FIGS. 9-14, the third pocket rear end 68 does not have an exit portal and instead is sewn shut with stitching 70.

Given that the second pocket rear end 60 and the third pocket rear end 68 are preferably closed, in preferred embodiments of the present invention, the user is unable to place the drumstick 42 in the second pocket interior and the third pocket interior. Instead, the user chooses one pocket based on the desired length.

The first pocket 32, the second pocket 56, and the third pocket 64 comprise an interior configured to receive the drumstick 42. (The first pocket interior is labelled with the numeral 39). Optionally, at least a portion of the second pocket interior and/or third pocket interior is lined with a non-slip surface, and the first pocket interior 39 adjacent to the first pocket front entry portal 34 does not comprise a non-slip surface. Without being bound by any particular theory, it has been observed that the non-slip surface is beneficial in the second pocket and/or third pocket interior to prevent slippage of the drumstick 42 but the non-slip surface can make it more difficult to position the drumstick 42 through the first pocket front entry portal 34. Hence, the non-slip surface is preferably not present near the first pocket front entry portal 34.

The non-slip surface is comprised of a different material than the material forming the remainder of the elastic sleeve 12. As a non-limiting example, if the sleeve 12 is comprised of spandex, the second or third pocket 56 and 64 may be lined with vinyl.

Optionally, in all embodiments of the invention, the first pocket front entry portal 34 is adjacent to the sleeve front end 20.

Figure 13:
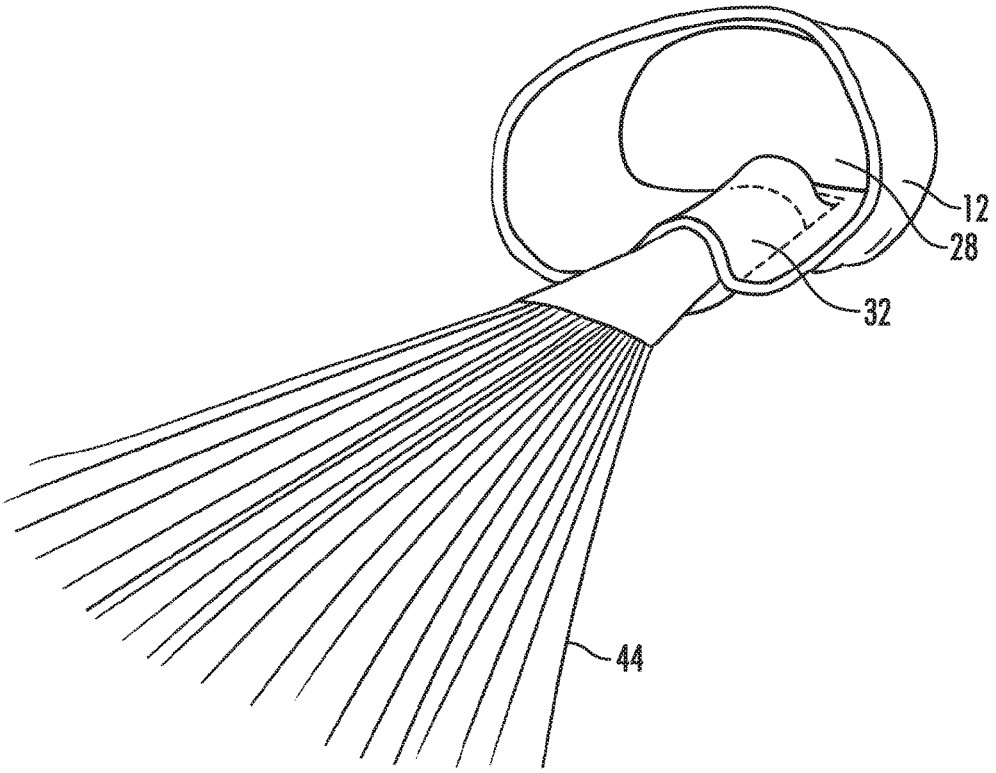
FIG. 13 illustrates a front perspective view of the drumstick sleeve of FIG. 9.
Figure 14:
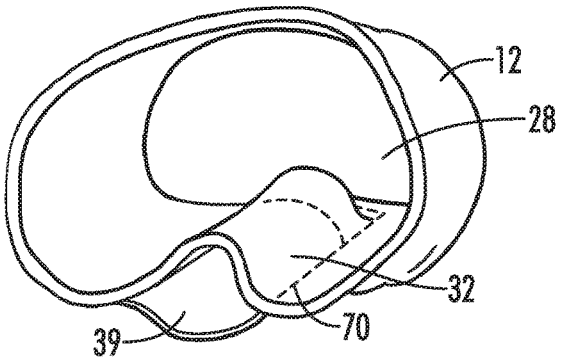
FIG. 14 illustrates a front perspective view of the drumstick sleeve of FIG. 9 without the drumstick.

The first pocket interior 39 is preferably generally hollow, as shown in FIGS. 13-14, so that it can receive the drumstick 42. Likewise the sleeve interior 28 is preferably generally hollow, as shown in FIG. 13, so that it can receive the human's arm 14. Preferably, the first pocket interior 39 is closed off from the sleeve interior 28 so that the drumstick 42, which is positioned in the first pocket interior 39, does not contact the human's arm 14 in the sleeve interior 28.

PART LIST

The following part list provides the numerals in the drawings.

| | |
|---|---|
| drumstick accessory system | 10 |
| elastic sleeve | 12 |
| human arm | 14 |
| human hand | 16 |
| palm | 18 |
| sleeve front end | 20 |
| sleeve rear end | 22 |
| sleeve length | 24 |
| sleeve width | 26 |
| sleeve interior | 28 |
| sleeve exterior | 30 |
| first pocket | 32 |
| first pocket front entry portal | 34 |
| first pocket rear exit portal | 36 |
| first pocket length | 38 |
| first pocket interior | 39 |
| at least one strap | 40 |
| drumstick | 42 |
| drumstick front end | 44 |
| drumstick rear end | 46 |
| drumstick length | 48 |
| strap first end | 49 |
| strap second end | 50 |
| fastener | 52 |
| drum | 54 |
| second pocket | 56 |
| second pocket front entry portal | 58 |
| second pocket rear end | 60 |
| second pocket length | 62 |
| third pocket | 64 |
| third pocket front entry portal | 66 |
| third pocket rear end | 68 |
| third pocket length | 69 |
| stitching | 70 |
| gap | 71 |

Having now described the invention in accordance with the requirements of the patent statutes, those skilled in the art will understand how to make changes and modifications to the disclosed embodiments to meet their specific requirements or conditions. Changes and modifications may be made without departing from the scope and spirit of the invention. In addition, the steps of any method described herein may be performed in any suitable order and steps may be performed simultaneously if needed.

Terms of degree such as "generally", "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

What is claimed is:

1. A method of wearing a drum brush sleeve system comprising the steps of a) providing an elastic sleeve configured to be worn around a user's arm and comprising a sleeve front end, a sleeve rear end, a sleeve length extending from the sleeve front end to the sleeve rear end, a sleeve width generally perpendicular to the sleeve length, a sleeve interior configured to receive the user's arm, a sleeve exterior, a first pocket comprising a first pocket front entry portal, a first pocket rear exit portal, a first pocket length extending from the first pocket front entry portal to the first pocket rear exit portal, the first pocket length generally parallel to the sleeve length;

b) providing a drum brush comprising a front end comprising a plurality of bristles, a rear end, a drum brush length extending from the drum brush front end to the drum brush rear end;

c) placing the elastic sleeve on an arm of a human user so that the plurality of bristles are positioned under a hand of the human user; and d) removably positioning the drum brush in the first pocket.

2. The method of claim 1, further comprising the step of contacting a drum with the plurality of bristles after step d).

3. The method of claim 1 wherein the first pocket front entry portal is located at the sleeve front end.

4. The method of claim 1 wherein the human user's hand comprises a palm and further wherein step b) comprises placing the sleeve front end below the human user's palm.

5. The method of claim 4 wherein the elastic sleeve is generally tubular in shape and is comprised of a substantially continuous wall surrounding the human user's arm.

6. The method of claim 1 wherein the elastic sleeve further comprises a second pocket comprising a second pocket front entry portal located to the rear of the first pocket rear exit portal, a second pocket closed rear end, a second pocket length extending from the second pocket front entry portal to the second pocket closed rear end, the second pocket length generally parallel to the sleeve length and the first pocket length.

7. The method of claim 6 wherein the drum brush rear end is located in the second pocket, in addition to the first pocket, in step d).

8. The method of claim 6 wherein the first pocket and the second pocket comprise an interior configured to receive the drum brush and wherein at least a portion of the second pocket interior is lined with a non-slip surface, and further wherein the first pocket interior adjacent to the first pocket front entry portal does not comprise a non-slip surface.

9. The method of claim 8 wherein the non-slip surface is comprised of a different material than the material forming the remainder of the elastic sleeve.

10. The method of claim 6 wherein the elastic sleeve further comprises a third pocket comprising a third pocket front entry portal, a third pocket closed rear end, a third pocket length extending from the third pocket front entry portal to the third pocket closed rear end, the third pocket length generally parallel to the sleeve length, the first pocket length and the second pocket length.

11. The method of claim 10 wherein the first pocket rear exit portal, the second pocket front entry portal and the third pocket front entry portal are aligned along the sleeve length.

12. The method of claim 10 wherein the drum brush rear end is located in the third pocket, in addition to the first pocket, in step d).

* * * * *